US009951562B2

(12) United States Patent
Gorrara

(10) Patent No.: US 9,951,562 B2
(45) Date of Patent: Apr. 24, 2018

(54) METHOD AND APPARATUS FOR ORIENTING A DOWNHOLE TOOL

(71) Applicant: NABORS LUX FINANCE 2 SARL, Luxembourg (DE)

(72) Inventor: Andrew Gorrara, Algard (NO)

(73) Assignee: NABORS LUX 2, Luxembourg (LU)

( * ) Notice: Subject to any disclaimer, the term of this patent is extended or adjusted under 35 U.S.C. 154(b) by 295 days.

(21) Appl. No.: 15/004,358

(22) Filed: Jan. 22, 2016

(65) Prior Publication Data

US 2016/0215611 A1 Jul. 28, 2016

Related U.S. Application Data

(60) Provisional application No. 62/108,390, filed on Jan. 27, 2015.

(51) Int. Cl.

| | |
|---|---|
| ***E21B 7/04*** | (2006.01) |
| ***E21B 47/024*** | (2006.01) |
| ***E21B 47/09*** | (2012.01) |
| ***E21B 7/06*** | (2006.01) |
| ***E21B 47/02*** | (2006.01) |
| ***E21B 47/00*** | (2012.01) |
| ***E21B 47/01*** | (2012.01) |

(52) U.S. Cl.

CPC ..... *E21B 7/06* (2013.01); *E21B 7/04* (2013.01); *E21B 7/062* (2013.01); *E21B 47/00* (2013.01); *E21B 47/01* (2013.01); *E21B 47/02* (2013.01)

(58) Field of Classification Search

CPC ... E21B 7/04; E21B 7/06; E21B 7/062; E21B 44/005; E21B 47/09; E21B 47/024

See application file for complete search history.

(56) References Cited

U.S. PATENT DOCUMENTS 5,265,682 A 11/1993 Russell et al.
5,458,208 A 10/1995 Clarke
(Continued)

FOREIGN PATENT DOCUMENTS

EP 0467642 A2 1/1992
WO 2014194418 A1 12/2014

OTHER PUBLICATIONS

Search Report Issued in European Application No. 16152726.2, dated Oct. 10, 2016, 8 pages.

*Primary Examiner* — Kenneth L Thompson
(74) *Attorney, Agent, or Firm* — Adolph Locklar

(57) ABSTRACT

The present disclosure provides for a sensor assembly for use in a wellbore. The sensor assembly may include a rotating sub, the rotating sub coupled to a drill string and a drive shaft, the drive shaft coupled to the rotating sub. The sensor assembly may also include a nonrotating sub where the nonrotating sub is positioned generally around the drive shaft and shaft and rotatably coupled to the drive shaft and the rotating sub. The nonrotating sub may include an outer cover. The outer cover is generally tubular. The nonrotating sub may further include a sensor collar. The sensor collar is positioned within and coupled to the outer cover. The sensor collar may be coupled to the outer cover by a drive assembly. The drive assembly may include a motor adapted to rotate the sensor collar relative to the outer cover. The nonrotating sub also includes at least one positioning sensor coupled to the sensor collar.

33 Claims, 3 Drawing Sheets

(56) References Cited

U.S. PATENT DOCUMENTS

| | | | | |
|---|---|---|---|---|
| 6,092,610 | A | 7/2000 | Kosmala et al. | |
| 6,948,572 | B2 * | 9/2005 | Hay | E21B 7/062 175/61 |
| 2003/0041661 | A1 | 3/2003 | Van Steenwyk et al. | |
| 2004/0222019 | A1 | 11/2004 | Estes et al. | |
| 2006/0263215 | A1 | 11/2006 | Sindt et al. | |
| 2009/0050370 | A1 | 2/2009 | Peters | |
| 2011/0036631 | A1 | 2/2011 | Prill et al. | |
| 2014/0262507 | A1 * | 9/2014 | Marson | E21B 7/10 175/24 |
| 2014/0291024 | A1 | 10/2014 | Sugiura et al. | |
| 2016/0060975 | A1 | 3/2016 | Gorrara | |
| 2017/0284158 | A1 * | 10/2017 | Hongbing | E21B 7/062 |

* cited by examiner

METHOD AND APPARATUS FOR ORIENTING A DOWNHOLE TOOL

CROSS-REFERENCE TO RELATED APPLICATIONS

The present application claims priority from U.S. Provisional Patent Application No. 62/108,390 filed on Jan. 27, 2015, the entirety of which is incorporated herein by reference.

TECHNICAL FIELD/FIELD OF THE DISCLOSURE

The present disclosure relates to sensor assemblies for use in a wellbore.

BACKGROUND OF THE DISCLOSURE

During the process of drilling a wellbore, information about the area surrounding the wellbore may be measured and logged to allow a driller to better understand the underground formation proximate the wellbore. In addition during drilling the wellbore, information regarding the location of structures including, for example and without limitation, wellbore casings or other metallic anomalies, commonly known as "fish," may also be measured and logged. The driller may use this information to locate known features in the Earth, identify material properties surrounding the wellbore, and avoid intersecting existing wells.

During certain drilling activities, a rotary steerable system (RSS) may be included as part of the bottom hole assembly (BHA) of a drill string. The RSS may be utilized to steer the drill bit as the wellbore is formed. Because of the length of the drill string, the continuous rotation of the drill string, and difficulty in obtaining reliable sensor readings in certain downhole conditions, the ability to orient the RSS with respect to the Earth may be used to ensure that the wellbore is progressing as desired. Additionally, by looking for known formations or other downhole features including fish, accurate orientation of the RSS may be achieved.

SUMMARY

The present disclosure provides for a sensor assembly for use in a wellbore. The sensor assembly includes a rotating sub, the rotating sub coupled to a drill string and a drive shaft, the drive shaft coupled to the rotating sub. The sensor assembly also includes a nonrotating sub where the nonrotating sub is positioned generally around the drive shaft and shaft and rotatably coupled to the drive shaft and the rotating sub. The nonrotating sub includes an outer cover. The outer cover is generally tubular. The nonrotating sub further includes a sensor collar. The sensor collar is positioned within and coupled to the outer cover. The sensor collar is coupled to the outer cover by a drive assembly. The drive assembly includes a motor adapted to rotate the sensor collar relative to the outer cover. The nonrotating sub also includes at least one positioning sensor coupled to the sensor collar.

The present disclosure also provides for a method for orienting a downhole tool. The method includes providing a drill string. The drill string includes a rotating sub, the rotating sub coupled to a drill string, and a drive shaft, the drive shaft coupled to the rotating sub. The drill string also includes a nonrotating sub. The nonrotating sub is generally tubular. The nonrotating sub is positioned generally around the drive shaft and coupled to the drive shaft and the rotating sub such that the nonrotating sub is free to rotate relative thereto. The nonrotating sub includes an outer cover, where the outer cover is generally tubular and a sensor collar. The sensor collar is positioned within and coupled to the outer cover. The sensor collar is coupled to the outer cover by a drive assembly. The drive assembly includes a motor adapted to rotate the sensor collar relative to the outer cover. The nonrotating sub also includes at least one positioning sensor coupled to the sensor collar. The drill string also includes a control unit operably coupled to the motor and the sensor. The control unit is adapted to, in response to data detected by the positioning sensor, operate the motor to move the sensor collar relative to the nonrotating sub. The method for orienting a downhole tool also includes detecting with the positioning sensor at least one data point corresponding to a reference point in the surrounding formation, and rotating, with the motor, the sensor collar relative to the nonrotating sub such that the sensor collar remains generally in a desired orientation relative to the wellbore independent of any rotation of the nonrotating sub utilizing at least the reference point.

In addition, the present disclosure provides for a method including providing a drill string. The drill string includes a rotating sub, the rotating sub coupled to a drill string and a drive shaft, the drive shaft coupled to the rotating sub. The drill string also includes a nonrotating sub. The nonrotating sub is generally tubular. The nonrotating sub is positioned generally around the drive shaft and coupled to the drive shaft and the rotating sub such that the nonrotating sub is free to rotate relative thereto. The nonrotating sub includes an outer cover, the outer cover being generally tubular and a sensor collar. The sensor collar is positioned within and coupled to the outer cover. The sensor collar is coupled to the outer cover by a drive assembly. The drive assembly includes a motor adapted to rotate the sensor collar relative to the outer cover. The nonrotating sub also includes at least one borehole orientation sensor or formation sensor coupled to the sensor collar. The drill string additionally includes a control unit operably coupled to the motor and the sensor, where the control unit is adapted to, in response to data detected by the positioning sensor, operate the motor to move the sensor collar relative to the nonrotating sub. The method also includes taking a measurement with a sensor of the borehole orientation sensor or formation sensor, rotating, with the motor, the sensor collar relative to the nonrotating sub, and taking a second measurement with the sensor.

The present disclosure provides for a method for orienting a downhole tool. The method includes providing a drill string. The drill string includes a rotating sub, the rotating sub coupled to a drill string, and a drive shaft, the drive shaft coupled to the rotating sub. The drill string also includes a nonrotating sub. The nonrotating sub is generally tubular. The nonrotating sub is positioned generally around the drive shaft and coupled to the drive shaft and the rotating sub such that the nonrotating sub is free to rotate relative thereto. The nonrotating sub includes an outer cover, the outer cover being generally tubular, and a sensor collar. The sensor collar is positioned within and coupled to the outer cover. The sensor collar is coupled to the outer cover by a drive assembly. The drive assembly includes a motor adapted to rotate the sensor collar relative to the outer cover. The nonrotating sub also includes at least one positioning sensor coupled to the sensor collar. The drill string also includes a control unit operably coupled to the motor and the sensor. The control unit is adapted to, in response to data detected by the positioning sensor, operate the motor to move the sensor collar relative to the nonrotating sub. The drill string includes a rotating steerable system, the rotating steerable system coupled to the nonrotating housing. The method also includes detecting with the positioning sensor at least one data point corresponding to a reference point in the surrounding formation. Additionally, the method includes rotating, with the motor, the sensor collar relative to the nonrotating sub such that the sensor collar remains generally in a desired orientation relative to the wellbore independent of any rotation of the nonrotating sub utilizing at least the reference point. The method also includes maintaining a toolface of the RSS utilizing the orientation of the sensor collar as a reference for the RSS.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
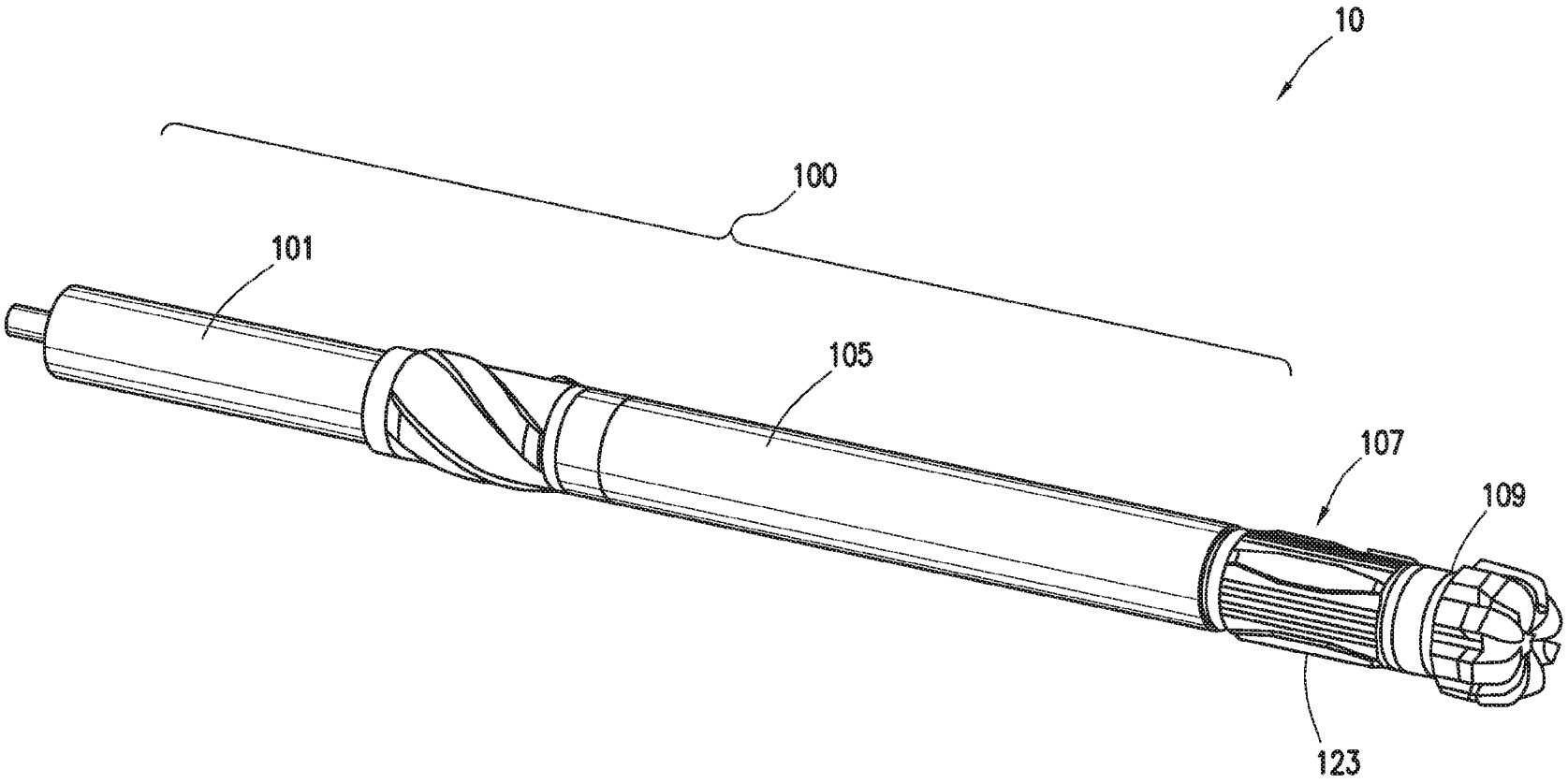
FIG. 1 depicts an elevation view of a BHA including a sensor assembly consistent with embodiments of this disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
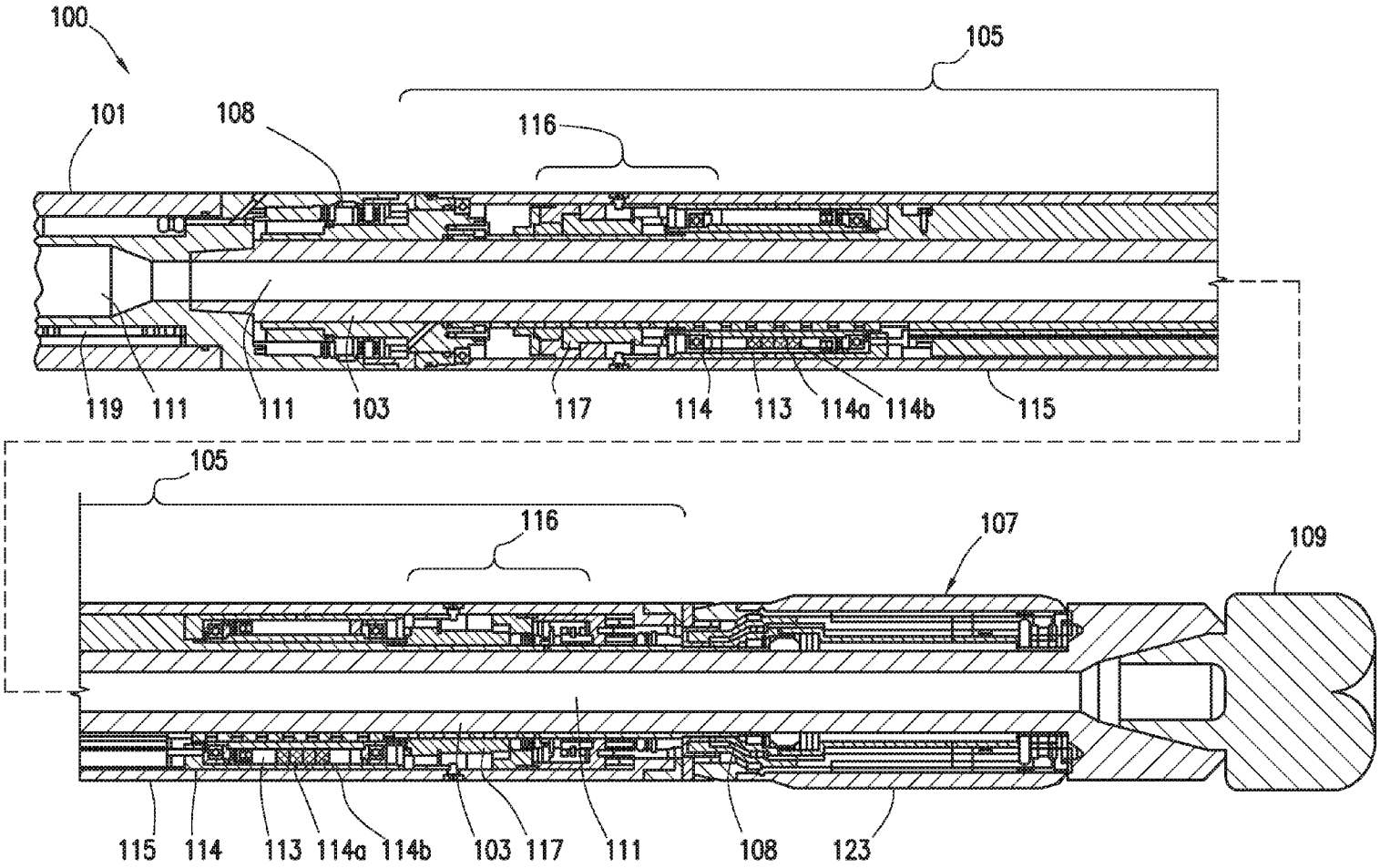
FIG. 2 depicts a partial cross section view of the BHA of FIG. 1.

As depicted in FIGS. 1, 2, sensor assembly 100 may include rotating sub 101, drive shaft 103, and nonrotating sub 105. Nonrotating sub 105 may be rotatably coupled to drive shaft 103 and rotating sub 101. Nonrotating sub 105 may, as understood in the art, slowly rotate relative to the surrounding wellbore at a speed slower than drive shaft 103. The rotation of nonrotating sub 105 may, for example and without limitation, be caused by friction between drive shaft 103 and nonrotating sub 105. Nonrotating sub 105 may rotate at a speed lower than, for example and without limitation 10 RPM while drive shaft 103 rotates at a higher speed. In some embodiments, sensor assembly 100 may be included as part of a drill string within a wellbore. In some embodiments, sensor assembly 100 may, as depicted in FIGS. 1, 2, be included as part of BHA 10 coupled to the end of the drill string. In some such embodiments, BHA 10 may be configured to include RSS 107 and drill bit 109. As understood in the art, in some embodiments, RSS 107 may be, for example and without limitation, a push-the-bit system, point-the-bit system, or any other rotary steerable directional drilling system. One having ordinary skill in the art with the benefit of this disclosure will understand that sensor assembly 100 may be utilized at any location along a drill string, and need not be used with an RSS. Furthermore, one having ordinary skill in the art with the benefit of this disclosure will understand that sensor assembly 100 may be utilized with other directional drilling systems including without limitation steerable motors and other slidable steerable systems.

In some embodiments, rotating sub 101 may be mechanically coupled to drive shaft 103. Rotating sub 101 may, in some embodiments, mechanically couple drive shaft 103 to the drill string. In some embodiments, drive shaft 103 may extend through bore 106 of nonrotating sub 105 to transfer rotational force from the rotation of the drill string to components such as drill bit 109 as depicted in FIG. 2. In some embodiments, drive shaft 103 may extend through RSS 107. In some embodiments, rotating sub 101 and drive shaft 103 may be generally tubular members which collectively form interior bore 111 through which drilling fluid may flow to drill bit 109 during drilling operations.

In some embodiments, nonrotating sub 105 may be rotatably coupled to drive shaft 103 and rotating sub 101 such that nonrotating sub 105 is capable of relative rotation thereto, but may rotate relative to the wellbore from, for example and without limitation, friction therebetween. In some embodiments, one or more bearings 108 may be positioned between drive shaft 103 and nonrotating sub 105 and rotating sub 101 and nonrotating sub 105 to, for example and without limitation, reduce friction therebetween. In some embodiments, one or more positioning sensors 113 may be located in nonrotating sub 105. Positioning sensors 113 may include, for example and without limitation, one or more gyros, accelerometers, or magnetometers. In some embodiments, one or more borehole orientation sensors 114*a* may be located in nonrotating sub 105 including, for example and without limitation, one or more gyros, accelerometers, or magnetometers. In some embodiments, one or more formation sensors 114*b* may be located in nonrotating sub 105 including, for example and without limitation, one or more gamma ray sensors, resistivity sensors, or sensors to measure formation porosity, formation density, or formation free fluid index. In some embodiments, nonrotating sub 105 may include outer cover 115 positioned to protect positioning sensors 113, borehole orientation sensors 114*a*, and formation sensors 114*b* from the downhole environment.

In some embodiments, depending on what types of positioning sensors 113, borehole orientation sensors 114*a*, and formation sensors 114*b* are included, outer cover 115 may be at least partially formed from a non-ferromagnetic material. In some embodiments, outer cover 115 may remain in a generally fixed rotational orientation relative to the surrounding wellbore by using one or more mechanical orientation features such as fins or ribs in contact with the surrounding wellbore. However, during the course of a drilling operation, outer cover 115 may slip or drift relative to the surrounding wellbore as rotating sub 101 imparts a torque on nonrotating sub 105. This relative movement between outer cover 115 and the surrounding wellbore, referred to herein as "slip" or "drift", may be further exacerbated by damage to the mechanical orientation features or wellbore conditions.

In some embodiments, borehole orientation sensors 114*a*, and formation sensors 114*b* may be coupled to sensor collar 114 positioned between drive shaft 103 and outer cover 115. Sensor collar 114 may be rotatably coupled to nonrotating sub 105. In some embodiments, nonrotating sub 105 may be coupled to sensor collar 114 through drive assembly 116 which may include motors 117. Motors 117 may rotate sensor collar 114 relative to nonrotating sub 105. By rotating sensor collar 114 at the same speed or approximately the same speed as the drift of outer cover 115 but in the opposite direction, sensors 113 in sensor collar 114 may remain generally fixed in orientation relative to the wellbore or the surrounding formation as the drill string is rotated during a drilling operation. In some embodiments, motors 117 may be electric motors, though one having ordinary skill in the art with the benefit of this disclosure will understand that any motor may be utilized, including without limitation, electric, hydraulic, or pneumatically driven motors.

In some embodiments, motors 117 may be mechanically coupled to outer cover 115. Motors 117 may rotate sensor collar 114 relative to nonrotating sub 105 by mechanical interconnection, including without limitation, one or more gears or pinions coupled to motors 117 and one or more gears or pinions coupled to one or more of nonrotating sub 105 and sensor collar 114.

In some embodiments, motors 117 may be controlled by control unit 119. FIG. 2 depicts control unit 119 positioned in rotating sub 101, although one having ordinary skill in the art with the benefit of this disclosure will understand that control unit 119 may be positioned anywhere in sensor assembly 100 without deviating from the scope of this disclosure. In some embodiments, control unit 119 may also include a processor adapted to receive sensor data from positioning sensors 113 in order to control the operation of motors 117 to position sensor collar 114 as described herein. For example, in embodiments in which positioning sensors 113 include an accelerometer, the data used may include a reading of the gravity field of the Earth. In embodiments in which positioning sensors 113 include a gyro, the data used may include a reading of the rotation of the Earth. In embodiments in which positioning sensors 113 include a magnetometer, the data used may include the magnetic field of the Earth or a known magnetic anomaly.

In some such embodiments, one or more of positioning sensors 113 may be used to maintain the orientation of sensor collar 114 relative to the wellbore and the surrounding formation. In such an embodiment, the orientation may be maintained utilizing a data point sensed by sensors 113 which corresponds to a fixed reference in the surrounding formation. In some embodiments, for example and without limitation, sensors 113 may include one or more gyros adapted to measure the Earth's rotation, accelerometers to measure gravity forces, or magnetometers to detect the Earth's magnetic field or other magnetic anomalies in the Earth. Information from sensors 113 may thus be utilized in order to drive motors 117 to maintain the orientation of nonrotating sub 105 without, in some embodiments, relying on any information regarding the rotation of rotating sub 101 or relative position sensors between nonrotating sub 105 and sensor collar 114. Thus, orientation of sensor collar 114 may be absolute relative to the wellbore or surrounding formation without relying on the relative orientation with nonrotating sub 105.

In embodiments in which control unit 119 is located in rotating sub 101, control unit 119 may be electrically coupled to sensors 113 and motors 117 located in nonrotating sub 105 by, for example and without limitation, one or more wired or wireless interfaces. In some embodiments, one or more slip rings or commutators may be positioned at the interface of rotating sub 101 and nonrotating sub 105 to allow continuous electrical connectivity. In some embodiments, a wireless interface such as an inductive coil may be located near the interface of rotating sub 101 and nonrotating sub 105, such as, for example and without limitation, the inductive coupler described in U.S. patent application Ser. No. 14/837,824, filed Aug. 27, 2015, the entirety of which is hereby incorporated by reference. In some embodiments in which control unit 119 is located in nonrotating sub 105, such a wired or wireless interface may be utilized to transmit power from a power source located in rotating sub 101 to control unit 119.

Additionally, in order to transmit power to or transmit or receive data from sensors 113 located in sensor collar 114, a wired or wireless interface may be utilized. For example, one or more slip rings or commutators may be used for power or data transmission. For embodiments utilizing a wireless interface, information and/or power may in some embodiments be transmitted through one or more inductive coils located at or near the interface between rotating sub 101 and nonrotating sub 105. In some embodiments, information may be transmitted through one or more radio frequency or electromagnetic communication links. One having ordinary skill in the art with the benefit of this disclosure will understand that any combination of wired or wireless links may be used without deviating from the scope of this disclosure.

In some embodiments, control unit 119 may further include data storage mechanisms adapted to store sensor data for later retrieval. In some embodiments, control unit 119 may include transmission mechanisms adapted to transmit data to the surface. In some embodiments, control unit 119, motors 117, and sensors 113 may be powered by, for example and without limitation, a battery, wired power supply, or a generator included with or coupled to sensor assembly 100.

As an example, in some embodiments, as understood in the art, RSS 107 may include RSS outer housing 123 which remains generally oriented with the wellbore during a directional drilling operation. Typically, RSS outer housing 123 remains in position by using one or more mechanical orientation features such as fins or ribs in contact with the surrounding wellbore. However, slippage or damage to these orientation features may cause the toolface of RSS 107 to drift or become otherwise unknown during a drilling operation. Toolface, as understood in the art and used herein, is reference direction of RSS 107 corresponding to a known direction relative to a reference coordinate system. In some embodiments, RSS outer housing 123 may be coupled to or formed as a part of nonrotating sub 105. By utilizing the known orientation of sensor collar 114 as a reference for RSS 107, the toolface of RSS 107 may be maintained relative to the surrounding formation. Thus, the path of the wellbore drilled thereby may be accurately guided.

Additionally, in some embodiments, by rotating sensor collar 114 relative to the wellbore irrespective of the rotation of nonrotating sub 105, one or more of borehole orientation sensors 114*a* and formation sensors 114*b* may be rotationally aimed within the wellbore. In such an embodiment, borehole orientation sensors 114*a* or formation sensors 114*b*, such as a magnetometer or gamma ray sensor may be accurately repositioned within the wellbore in order to, for example and without limitation, survey the surrounding formation. Because the orientation of sensor collar 114 relative to the surrounding formation is known and the rotation of sensor collar 114 may be precisely controlled by motors 117, the orientation, direction of rotation, and rate of rotation of borehole orientation sensors 114*a* or formation sensors 114*b* at each sensor reading may be known accurately. In some embodiments, formation properties measured by rotating borehole orientation sensors 114*a* or formation sensors 114*b* may be compiled to, for example and without limitation, generate a 3D representation of the formation around the wellbore. Additionally, by accurately determining properties of the surrounding formation, for example and without limitation, the wellbore may be drilled to remain within or close to a desired formation layer.

Figure 3A:
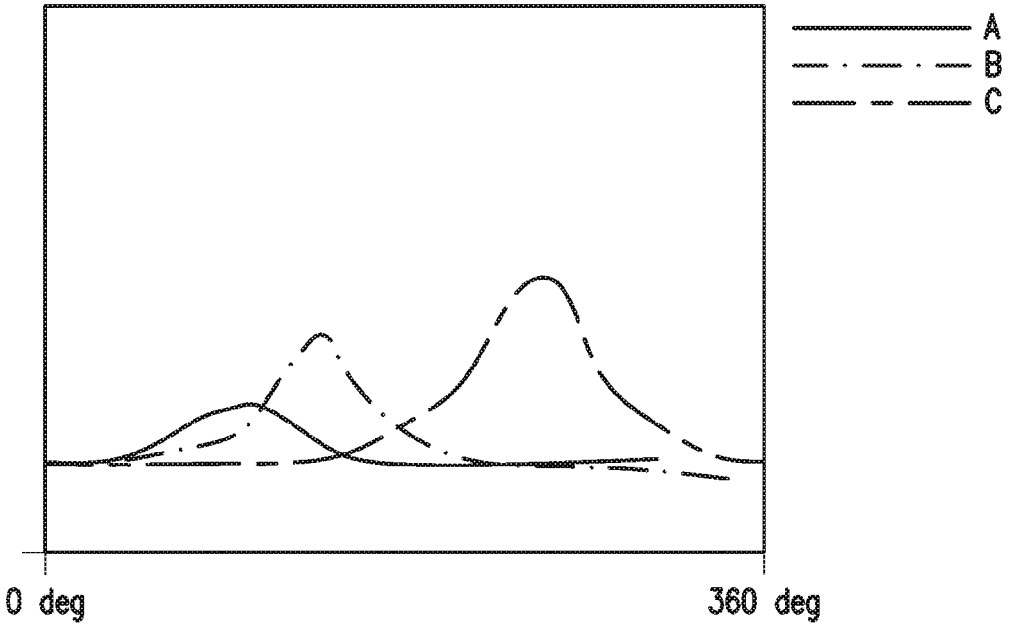
FIG. 3*a* depicts an example of the readings of a sensor assembly consistent with embodiments of the present disclosure for three magnetic anomalies as shown in FIG. 3*b*.
Figure 3B:
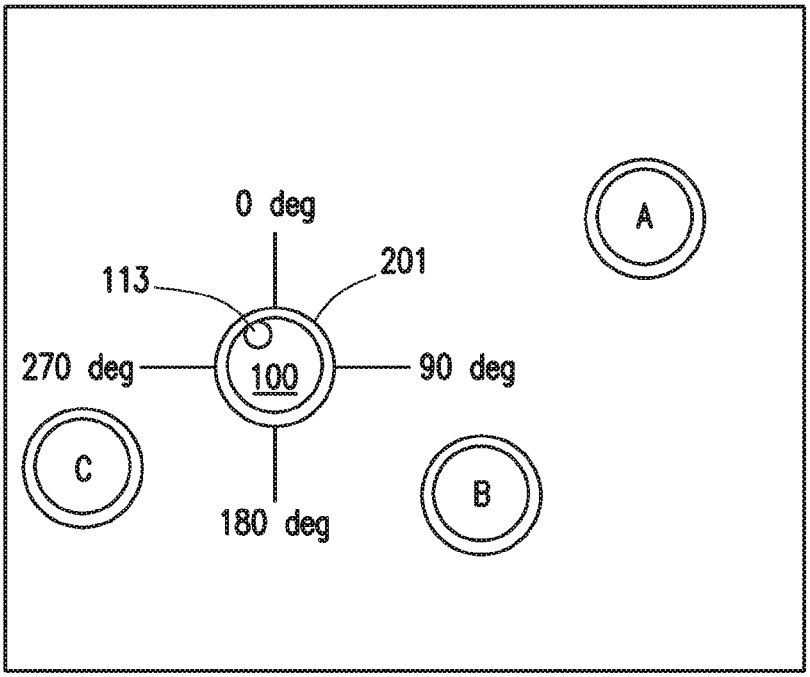

Additionally, downhole formation features or other objects may be accurately located relative to the wellbore. As an example, FIGS. 3*a*, 3*b* depict a measurement operation to locate a metal tubular in the formation surrounding wellbore 201 in which sensor assembly 100 is positioned. FIG. 3*b* depicts three possible locations A, B, C, for a tubular positioned near wellbore 201. By interpreting magnetometer data, the location of the tubular may be determined by, for example and without limitation, finding the offset angle of the sensor at which the maximum magnetic anomaly is detected. FIG. 3*a* depicts a graph of magnetometer data against offset angle for each possible location. The offset angle may be determined by control unit 119. By knowing the location of the tubular, the desired drilling operation may continue. For example, collision with the detected tubular may be avoided in a crowded reservoir. Alternatively, the wellbore may be drilled a desired distance from the detected tubular or remain parallel thereto as in an enhanced recovery operation such as a steam-assisted gravity drainage operation. As another example, in a well intervention, the detected tubular may be targeted to be intercepted by the wellbore being drilled.

In some embodiments, control unit 119 may include a computer readable memory module which may include pre-programmed instructions for controlling sensor collar 114. In some embodiments, control unit 119 may include a receiver for receiving instructions. In some embodiments, control unit 119 may include a transmitter for transmitting information or control signals to other downhole equipment, including, for example and without limitation, RSS 107. The communication medium for the receiver and/or transmitter may include, for example and without limitation, a wired connection, mud pulse communication, electromagnetic transmission, or any other communication protocol known in the art. In some embodiments, the instructions may include, for example and without limitation, rotate sensor collar 114 to locate a maximum magnetic reading and identify the direction to the maximum magnetic reading using the offset angle of the sensor. In some embodiments, the instructions may include rotate sensor collar 114 to locate a geological anomaly such as, for example and without limitation, a natural gamma ray reading and identify the direction to the geological anomaly using the offset angle of the sensor. In some embodiments, the instruction may further include transmitting a command to RSS 107 to steer toward or away from the identified direction.

In some embodiments, the instructions may include rotating sensor collar 114 while collecting data from one or more of borehole orientation sensors 114*a* or formation sensors 114*b* to, for example and without limitation, generate a model of the wellbore and surrounding formation. In some embodiments, such data may be collected as sensor assembly 100 is moved through the wellbore. In such an embodiment, the model of the wellbore may be three dimensional.

Although described herein as utilizing only a single sensor collar 114, one having ordinary skill in the art with the benefit of this disclosure will understand that multiple sensor collars 114, each having their own sensors 113 may be included in nonrotating sub 115 without deviating from the scope of this disclosure. Additionally, one having ordinary skill in the art with the benefit of this disclosure will understand that each sensor collar 114 may be driven independently by separate motors 117.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A sensor assembly for use in a wellbore comprising:
a rotating sub, the rotating sub coupled to a drill string;
a drive shaft, the drive shaft coupled to the rotating sub;
a nonrotating sub, the nonrotating sub positioned generally around the drive shaft and coupled to the drive shaft and rotatably coupled to the drive shaft and the rotating sub, the nonrotating sub including:
an outer cover, the outer cover being generally tubular;
a sensor collar, the sensor collar positioned within and coupled to the outer cover, the sensor collar coupled to the outer cover by a drive assembly, the drive assembly including a motor adapted to rotate the sensor collar relative to the outer cover; and
at least one positioning sensor coupled to the sensor collar.

2. The sensor assembly of claim 1, wherein the positioning sensor comprises one or more of a gyro, accelerometer, or magnetometer.

3. The sensor assembly of claim 1, further comprising one or more borehole orientation sensors coupled to the sensor collar.

4. The sensor assembly of claim 3, wherein the one or more borehole orientation sensors comprise one or more gyros, accelerometers, or magnetometers.

5. The sensor assembly of claim 1, further comprising one or more formation sensors coupled to the sensor collar.

6. The sensor assembly of claim 5, wherein the one or more formation sensors comprise one or more gamma ray sensors, resistivity sensors, or sensors to measure formation porosity, formation density, or formation free fluid index.

7. The sensor assembly of claim 1, further comprising a control unit operably coupled to the motor and the sensor, the control unit adapted to, in response to data detected by the positioning sensor, operate the motor to move the sensor collar relative to the outer cover.

8. The sensor assembly of claim 7, wherein the control unit determines an orientation of the sensor collar relative to the wellbore based on the data detected by the positioning sensor.

9. The sensor assembly of claim 8, wherein the positioning sensor is an accelerometer and the data corresponds to the gravity field of the Earth.

10. The sensor assembly of claim 8, wherein the positioning sensor comprises a gyro, and the data corresponds to the rotation of the Earth.

11. The sensor assembly of claim 8, wherein the positioning sensor comprises a magnetometer, and the data corresponds to the magnetic field of the Earth or a known magnetic anomaly.

12. The sensor assembly of claim 7, wherein the control unit, motor, and sensor are powered by a battery, wired power source, or generator.

13. The sensor assembly of claim 7, wherein the control unit further comprises a storage medium adapted to store data collected by the sensor.

14. A method for orienting a downhole tool comprising:
providing a drill string, the drill string including:
a rotating sub, the rotating sub coupled to a drill string;
a drive shaft, the drive shaft coupled to the rotating sub;
a nonrotating sub, the nonrotating sub being generally tubular, the nonrotating sub positioned generally around the drive shaft and coupled to the drive shaft and the rotating sub such that the nonrotating sub is free to rotate relative thereto, the nonrotating sub including:
an outer cover, the outer cover being generally tubular;
a sensor collar, the sensor collar positioned within and coupled to the outer cover, the sensor collar coupled to the outer cover by a drive assembly, the drive assembly including a motor adapted to rotate the sensor collar relative to the outer cover; and
at least one positioning sensor coupled to the sensor collar; and
a control unit operably coupled to the motor and the sensor, the control unit adapted to, in response to data detected by the positioning sensor, operate the motor to move the sensor collar relative to the nonrotating sub;
detecting with the positioning sensor at least one data point corresponding to a reference point in the surrounding formation; and
rotating, with the motor, the sensor collar relative to the nonrotating sub such that the sensor collar remains generally in a desired orientation relative to the wellbore independent of any rotation of the nonrotating sub utilizing at least the reference point.

15. The method of claim 14, wherein the positioning sensor is an accelerometer and the data corresponds to the gravity field of the Earth.

16. The method of claim 14, wherein the positioning sensor comprises a gyro, and the data corresponds to the rotation of the Earth.

17. The method of claim 14, wherein the positioning sensor comprises a magnetometer, and the data corresponds to the magnetic field of the Earth or a known magnetic anomaly.

18. The method of claim 14, wherein the orientation of the sensor collar is maintained such that the sensor collar is rotationally fixed with respect to the wellbore.

19. The method of claim 14, further comprising:
determining an initial orientation of the sensor collar utilizing the reference point;
detecting with the sensor at least a first data point;
rotating the sensor collar a known amount relative to the wellbore;
detecting with the sensor at least a second data point.

20. The method of claim 14, further comprising rotating the sensor collar to a desired orientation relative to the wellbore independent of any slip or drift of the nonrotating sub.

21. The method of claim 14, further comprising rotating the sensor collar to a desired orientation or at a desired rate of rotation relative to the wellbore independent of any slip or drift of the nonrotating sub.

22. The method of claim 14, wherein the drill string further comprises one or more borehole orientation sensors coupled to the sensor collar.

23. The method of claim 22, wherein the one or more borehole orientation sensors comprise one or more gyros, accelerometers, or magnetometers.

24. The method of claim 22, further comprising receiving readings from the borehole orientation sensors at different orientations as the sensor collar is rotated relative to the wellbore, the control unit adapted to record the orientation relative to the wellbore at which each reading is taken.

25. The method of claim 14, wherein the drill string further comprises one or more formation sensors coupled to the sensor collar.

26. The method of claim 25, wherein the one or more formation sensors comprise one or more gamma ray sensors, resistivity sensors, or sensors to measure formation porosity, formation density, or formation free fluid index.

27. The method of claim 22, further comprising receiving readings from the formation sensors sensors at different orientations as the sensor collar is rotated relative to the wellbore, the control unit adapted to record the orientation relative to the wellbore at which each reading is taken.

28. The method of claim 14, further comprising steering a rotary steerable system based at least in part on the determined orientation.

29. A method comprising:
providing a drill string, the drill string including:
a rotating sub, the rotating sub coupled to a drill string;
a drive shaft, the drive shaft coupled to the rotating sub;
a nonrotating sub, the nonrotating sub being generally tubular, the nonrotating sub positioned generally around the drive shaft and coupled to the drive shaft and the rotating sub such that the nonrotating sub is free to rotate relative thereto, the nonrotating sub including:
an outer cover, the outer cover being generally tubular;
a sensor collar, the sensor collar positioned within and coupled to the outer cover, the sensor collar coupled to the outer cover by a drive assembly, the drive assembly including a motor adapted to rotate the sensor collar relative to the outer cover; and
at least one borehole orientation sensor or formation sensor coupled to the sensor collar; and
a control unit operably coupled to the motor and the sensor, the control unit adapted to, in response to data detected by the orientation sensor or formation sensor, operate the motor to move the sensor collar relative to the nonrotating sub;
taking a measurement with a sensor of the borehole orientation sensor or formation sensor;
rotating, with the motor, the sensor collar relative to the nonrotating sub; and
taking a second measurement with the sensor.

30. The method of claim 29, wherein the sensor is a magnetometer.

31. The method of claim 29, wherein the drill string further comprises a positioning sensor coupled to the sensor collar.

32. The method of claim 31, further comprising:
detecting with the positioning sensor at least one data point corresponding to a reference point in the surrounding formation; and
determining an offset angle at which the first and second measurements were taken with the control unit.

33. A method for orienting a downhole tool comprising:

providing a drill string, the drill string including:

a rotating sub, the rotating sub coupled to a drill string;

a drive shaft, the drive shaft coupled to the rotating sub;

a nonrotating sub, the nonrotating sub being generally tubular, the nonrotating sub positioned generally around the drive shaft and coupled to the drive shaft and the rotating sub such that the nonrotating sub is free to rotate relative thereto, the nonrotating sub including:

an outer cover, the outer cover being generally tubular;

a sensor collar, the sensor collar positioned within and coupled to the outer cover, the sensor collar coupled to the outer cover by a drive assembly, the drive assembly including a motor adapted to rotate the sensor collar relative to the outer cover; and at least one positioning sensor coupled to the sensor collar;

a control unit operably coupled to the motor and the sensor, the control unit adapted to, in response to data detected by the positioning sensor, operate the motor to move the sensor collar relative to the nonrotating sub; and a rotating steerable system (RSS), the RSS coupled to the nonrotating housing;

detecting with the positioning sensor at least one data point corresponding to a reference point in the surrounding formation;

rotating, with the motor, the sensor collar relative to the nonrotating sub such that the sensor collar remains generally in a desired orientation relative to the wellbore independent of any rotation of the nonrotating sub utilizing at least the reference point; and maintaining a toolface of the RSS utilizing the orientation of the sensor collar as a reference for the RSS.

* * * * *